US010259105B2

(12) United States Patent
Liu et al.

(10) Patent No.: US 10,259,105 B2
(45) Date of Patent: Apr. 16, 2019

(54) JIG FOR ASSEMBLING CURVED-SURFACE DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Jie Liu, Beijing (CN); Xiang Li, Beijing (CN); Bochang Wang, Beijing (CN); Honglin Zhang, Beijing (CN); Seung Min Lee, Beijing (CN); Xibin Shao, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 125 days.

(21) Appl. No.: 15/541,966

(22) PCT Filed: Jul. 29, 2016

(86) PCT No.: PCT/CN2016/092352

§ 371 (c)(1),
(2) Date: Jul. 6, 2017

(87) PCT Pub. No.: WO2017/063431

PCT Pub. Date: Apr. 20, 2017

(65) Prior Publication Data

US 2018/0009087 A1 Jan. 11, 2018

(30) Foreign Application Priority Data

Oct. 14, 2015 (CN) ..... 2015 1 0662268

(51) Int. Cl.
*B25B 11/02* (2006.01)

(52) U.S. Cl.
CPC ..... *B25B 11/02* (2013.01)

(58) Field of Classification Search
CPC . B25B 11/02; B25B 5/06; B25B 5/006; B66F 7/16; B66F 7/20; B66F 7/22
(Continued)

(56) References Cited

U.S. PATENT DOCUMENTS 1,283,795 A * 11/1918 Kelley ..... B25B 5/006 254/133 R
4,209,164 A * 6/1980 Brothers ..... B23K 3/08 269/239

(Continued)

FOREIGN PATENT DOCUMENTS

CN 1892919 A 1/2007
CN 101229598 A 7/2008

(Continued)

OTHER PUBLICATIONS

ISR and Written Opinion dated Nov. 10, 2016; PCT/CN2016/092352.

(Continued)

*Primary Examiner* — George B Nguyen
(74) *Attorney, Agent, or Firm* — Ladas & Parry LLP

(57) ABSTRACT

A jig for assembling a curved surface display device includes: a base station, which is provided with a bearing surface; a support frame provided on the bearing surface; and a bottom surface support plate provided on the bearing surface to support back of the curved surface display device. The support frame is provided with a plurality of corner support pieces to support corners of the curved surface display device, a distance between each of the corner support pieces and the bearing surface is adjustable.

20 Claims, 3 Drawing Sheets

(58) Field of Classification Search
USPC ..... 269/55, 103, 111
See application file for complete search history.

(56) References Cited

U.S. PATENT DOCUMENTS

| | | | | |
|---|---|---|---|---|
| 4,256,296 | A * | 3/1981 | Scheinert | B25B 11/02 269/297 |
| 4,332,366 | A * | 6/1982 | Descals Munt | B23Q 1/03 248/172 |
| 4,861,008 | A * | 8/1989 | Steele | B25B 11/005 269/21 |
| 5,653,011 | A * | 8/1997 | Collins | B25B 11/00 269/317 |
| 2007/0007413 | A1* | 1/2007 | Jung | F16M 11/10 248/284.1 |
| 2011/0167604 | A1* | 7/2011 | Stewart | B25B 11/02 29/271 |
| 2012/0080391 | A1* | 4/2012 | Nakamura | G06F 1/181 211/26 |
| 2012/0145849 | A1* | 6/2012 | Yeum | B25B 11/02 248/220.21 |
| 2013/0026691 | A1* | 1/2013 | Cahill | B25H 1/0007 269/37 |
| 2013/0044461 | A1 | 2/2013 | Liu | |
| 2016/0324042 | A1 | 11/2016 | Wu | |

FOREIGN PATENT DOCUMENTS

| | | | | |
|---|---|---|---|---|
| CN | 201147809 | Y | 11/2008 | |
| CN | 201434950 | Y | 3/2010 | |
| CN | 102284917 | A | 12/2011 | |
| CN | 103100889 | A | 5/2013 | |
| CN | 103203729 | A | 7/2013 | |
| CN | 103878238 | A | 6/2014 | |
| CN | 203732239 | U | 7/2014 | |
| CN | 104260972 | A | 1/2015 | |
| CN | 104443846 | A | 3/2015 | |
| CN | 104729766 | A | 6/2015 | |
| CN | 204377027 | U | 6/2015 | |
| CN | 104777652 | A | 7/2015 | |
| CN | 105118385 | A | 12/2015 | |
| JP | 10198283 | A | 7/1998 | |
| JP | 2011-048115 | A | 3/2011 | |
| KR | 101447068 | B1 | 9/2014 | |
| WO | WO-9808658 | A1 * | 3/1998 | B25B 11/02 |

OTHER PUBLICATIONS

The First Chinese Office Action dated Apr. 18, 2017; Appln. No. 201510662268.6.
The Second Chinese Office Action dated Nov. 16, 2017; Appln. No. 201510662268.6.

* cited by examiner

JIG FOR ASSEMBLING CURVED-SURFACE DISPLAY DEVICE

TECHNICAL FIELD

Embodiments of the present disclosure relate to a jig for assembling a curved surface display device.

BACKGROUND

When a curved surface display device is assembled, because its bottom surface is a cambered surface, an assembly jig is required to support the curved surface display device, so as to avoid defects of products caused by assembly fault due to unstable placement of the curved surface display device during an assembling process. The assembly jig for display device is generally designed for a flat display device, and the supporting surface of its supporting mechanism is a plane, and cannot stably support a curved surface display device, and the assembly jig cannot be applied to the assembly of the curved surface display device.

In addition, after finishing assembly of the display device, the display device needs to be erected for back assembly or for testing. In general, the display device needs to be transferred to another jig to carry on the erection of the display device, which increases steps of assembling or testing the display device.

SUMMARY

An embodiment of the present disclosure provides a jig for assembling a curved surface display device and it can be applied to and bear curved surface display devices with different curvature.

One embodiment of the present disclosure provides a jig for assembling a curved surface display device, comprising: a base station, a support frame and a bottom surface support plate. The base station is provided with a bearing surface, and the support frame is provided on the bearing surface. The support frame is provided with a plurality of corner support pieces configured to support corners of the curved surface display device, a distance between each of the corner support pieces and the bearing surface is adjustable; and the bottom surface support plate is provided on the bearing surface to support back of the curved surface display device.

For example, each of the corner support pieces is connected with the support frame by a lifting mechanism.

For example, the lifting mechanism comprises screws which are in one-to-one correspondence with the corner support pieces; the screws are pivoted on the support frame and the corner support pieces are provided with thread holes matching with threads of the screws; and/or the screws are installed on the corner support pieces, and the support frame is provided with thread holes connected with the threads of the screws.

For example, the plurality of corner support pieces comprise: four corner support blocks which are in one-to-one correspondence with four corners of a frame of the curved surface display device, the four corner support blocks are in a rectangular pattern distribution, and each of the corner support blocks is configured to support a corresponding corner corresponding in the frame. For example, the plurality of corner support pieces can further comprise at least one pair of side support blocks disposed opposite to each other and configured to support sides disposed opposite to each other in a frame of the curved surface display device.

For example, each of the corner support blocks comprises a support surface configured to support a lateral face of two sides forming a corresponding corner in the frame towards the bearing surface; and position-limiting surfaces configured to limit a position of two sides forming the corresponding corner in the frame in a direction perpendicular to the bearing surface.

For example, each of the side support blocks comprises: a support surface configured to support a lateral face of a corresponding side in the frame towards the bearing surface; a position-limiting surface configured to limit a position of a corresponding side in the frame in a direction perpendicular to the bearing surface.

For example, the bottom surface support plate is provided with a connecting mechanism configured to hook a bottom surface of the curved surface display device.

For example, the connecting mechanism is a wall-hanging installation groove provided on the bottom surface support plate and configured to match and connect with a wall-hanging convex structure on the bottom surface of the curved surface display device.

For example, the bottom surface support plate is connected with the base station by a link mechanism, the link mechanism is configured to lift and turn the bottom surface support plate to a position having an angle with respect to the bearing surface.

For example, the link mechanism comprises at least three link rods, and one terminal of each of the three link rods is hinged on one side of the bottom surface support plate deviating from the corner support pieces, and hinge positions are in a triangular pattern distribution. For example, the three link rods can be moved along the direction perpendicular to the bearing surface, and the link rod located in a vertex of a triangle can be moved along the direction perpendicular to a base of the triangle within an extending direction of the bearing surface.

For example, the support frame comprises: two first slide rails arranged side by side and being in parallel with the bearing surface; two second slide rails arranged side by side, being in parallel with the bearing surface and being perpendicular to the first slide rails. For example, each of the second slide rails is installed on the two first slide rails and can slide along the extending direction of the first slide rails, and each of the corner support pieces is installed on the second slide rails and can slide along the extending direction of the second slide rails.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

REFERENCE NUMBERS OF DRAWINGS

01, curved surface display device; 10, base station; 11, bearing surface; 20, support frame; 21, 22, first slide rail; 23, 24, second slide rail; 30, corner support piece; 31, 32, 33, 34, corner support block; 35, 36, side support block; 40, bottom surface support plate; 41, wall-hanging installation groove; 50, lifting mechanism; 51, screw; 60, link mechanism; 61, 62, 63, link rod.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
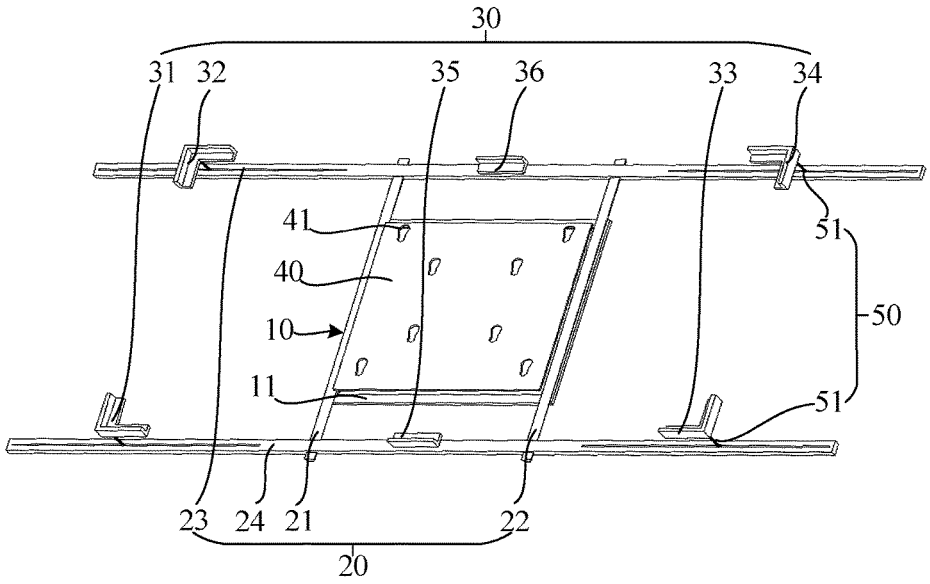
FIG. 1 is a structural schematic diagram of a jig for assembling a curved surface display device provided by an embodiment of the present disclosure.

As shown in FIG. 1, an embodiment of the present disclosure provides a jig for assembling a curved surface display device, comprising: a base station 10, a support frame 20 and a bottom surface support plate 40. The base station 10 is provided with a bearing surface 11; the support frame 20 is provided on the bearing surface 11, the support frame is provided with a plurality of corner support pieces 30 configured to support corners of the curved surface display device, and a distance between the corner support pieces 30 and the bearing surface 11 is adjustable; and the bottom surface support plate 40 is provided on the bearing surface 11 to support the back of the curved surface display device.

Figure 2:
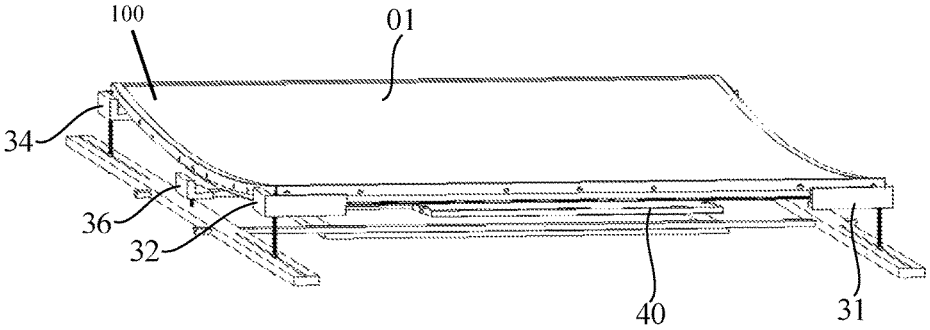
FIG. 2 is a schematic diagram showing a whole structure of the curved surface display device placed on the jig shown in FIG. 1.

As shown in FIG. 2, in the process of using the jig, when the curved surface display device 01 is placed on the base station 10, the bottom surface support plate 40 supports the back of the curved surface display device 01, and the corner support pieces 30 can cooperate to support the corners of the curved surface display device 01 well as a frame 100 of the curved surface display device 01 by adjusting the distance between the corner support pieces 30 and the bearing surface 11 of the base station 10. The above-mentioned jig for assembling a curved display device can support both the back and the frame 100 of the curved surface display device 01 at the same time when the curved surface display device 01 is placed on the base station 10, which reduces the probability of defects of product caused by unstable placement of the curved surface display device 01 during an assembling process and reduces the production efficiency of curved surface display device 01.

As shown in FIG. 1, in a preferred example of the present disclosure, each of the corner support pieces 30 is connected with the support frame 20 by a lifting mechanism 50 configured to adjust the distance between the corner support pieces 30 and the bearing surface 11.

Figure 3:
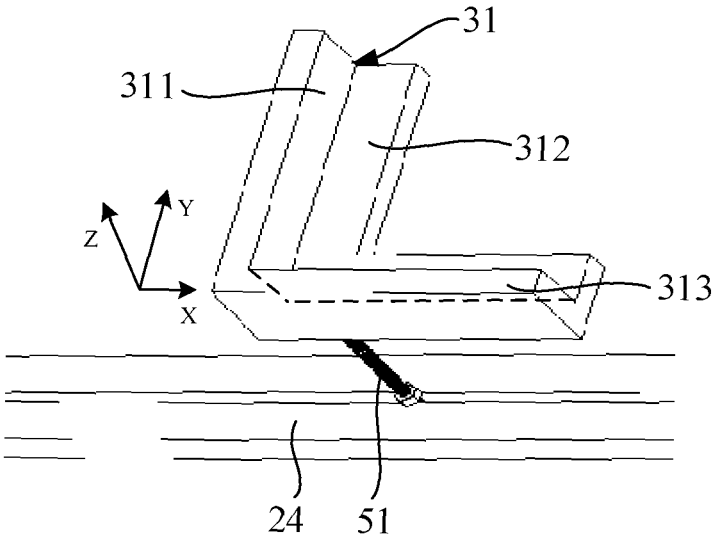
FIG. 3 is a structural schematic diagram of a corner support block and a screw.

For example, as shown in FIG. 1, the lifting mechanism 50 can comprise screws 51 which are in one-to-one correspondence with the corner support pieces 30. The screws 51 can be connected with the support frame 20 and the corner support pieces 30 in various ways. For example, the screws 51 can be pivoted on the support frame 20, and the corner support pieces 30 are provided with thread holes matching with threads of the screws; or as shown in FIG. 3, the screws 51 are installed on the corner support pieces 30, and the support frame 20 is provided with the thread holes connected with the threads of the screws 51.

In a preferred example as shown in FIG. 1, the corner support pieces 30 of the jig, for example, comprise: four corner support blocks which are in one-to-one correspondence with four corners of the frame 100 of the curved surface display device 01; the four corner support blocks are shown in FIG. 1, i.e., a corner support block 31, a corner support block 32, a corner support block 33 and a corner support block 34. The four corner support blocks 31-34 are in a rectangular pattern distribution, and each of the corner support blocks 31-34 is respectively used to support a corner in the frame 100 correspondingly.

The jig, for example, further comprises side support blocks 35, 36 disposed opposite to each other and configured to support the sides disposed opposite to each other in the frame 100 of the curved surface display device 01.

For example, each of the corner support blocks comprises: a support surface configured to support a lateral face forming two sides of a corresponding corner in the frame 100 towards the bearing surface 11; and position-limiting surfaces configured to limit the position of the two sides forming a corresponding corner in the frame 100 in a direction perpendicular to the bearing surface 11.

As shown in FIG. 3, by taking the corner support block 31 as an example, the corner support block 31 comprises: a support surface 312, a position-limiting surface 311 and a position-limiting surface 313, which can support the curved surface display device in three directions of X, Y and Z as shown in the figure. The stability of the curved surface display device supported by the corner support pieces is improved. More specifically, the position-limiting surface 311 and the position-limiting surface 313 are perpendicular to each other and correspond to the two sides of the frame 100 of the curved surface display device 01; the support surface 312 is perpendicular to the position-limiting surface 311 and the position-limiting surface 313, and corresponds to the back of the curved surface display device 01.

For example, each of the side support blocks comprises: a support surface configured to support a lateral face of a corresponding side in the frame towards the bearing surface 11; a position-limiting surface configured to limit a position of a corresponding side in the frame 100 in a direction perpendicular to the bearing surface 11.

Figure 4:
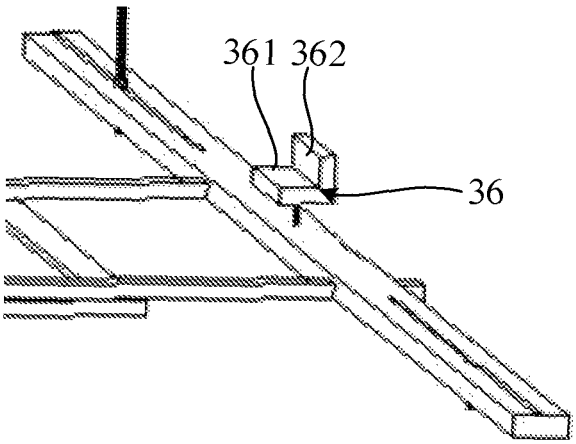
FIG. 4 is a structural schematic diagram of a side support block.

As shown in FIG. 4, by taking the side support block 36 as an example, the side support block 36 comprises: a support surface 361 and a position-limiting surface 362. The support surface 361 and the position-limiting surface 362 are perpendicular to each other. The side support blocks further improve the stability of the curved surface display device supported by the corner support pieces in process of supporting the curved surface display device, especially the curved surface display device in a large size.

In a preferred example, in order to enhance the stability of placing the curved surface display device, the bottom surface support plate is provided with a connecting mechanism configured to hook the bottom surface of the curved surface display device.

For example, as shown in FIG. 1, the connecting mechanism is a wall-hanging installation groove 41 provided on the bottom surface support plate 40, the wall-hanging installation groove 41 is configured to match and connect with a wall-hanging convex structure (not shown in the figure) on the bottom surface of the curved surface display device 01. For example, the wall-hanging installation groove 41 is a VESA standard wall-hanging installation groove. When the curved surface display device 01 is supported, the wall-hanging convex structure on the bottom surface of the curved surface display 01 is matched and connected with the wall-hanging installation groove 41, which makes the surface display device 01 more stable and can be used to turn the curved surface display device 01.

Figure 5:
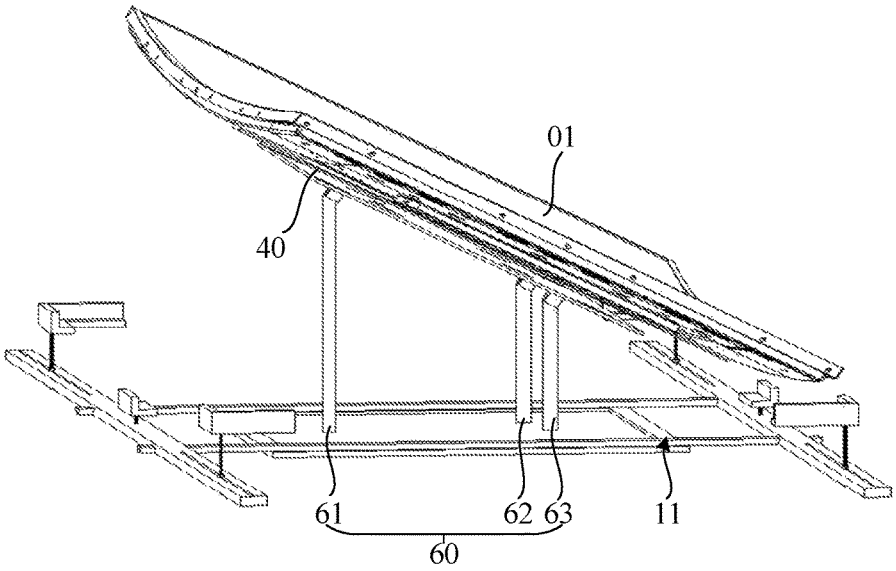
FIG. 5 is a schematic diagram of a working principle of a link mechanism.
Figure 6:
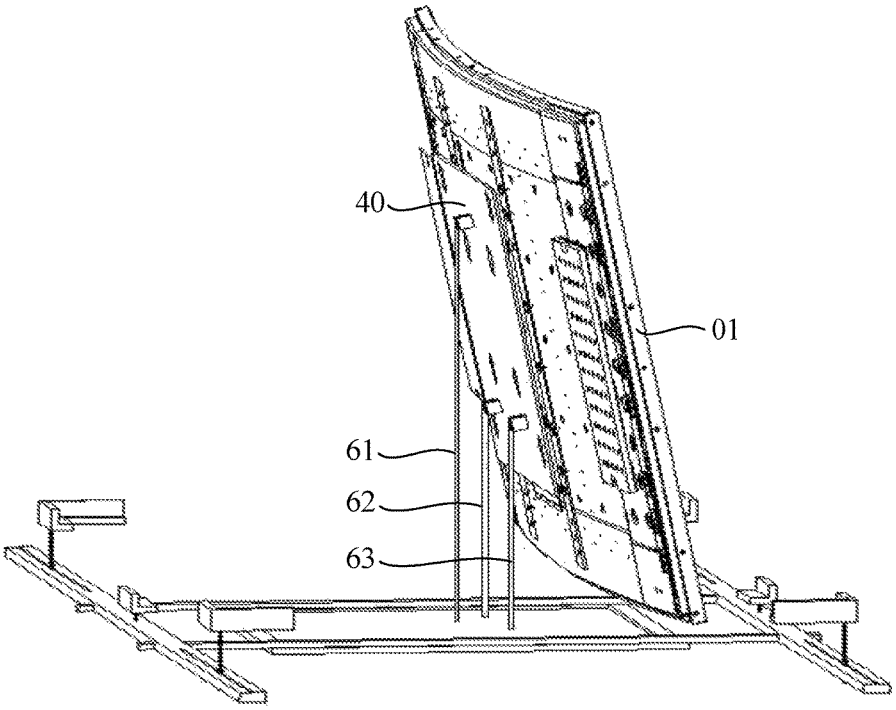
FIG. 6 is a schematic diagram of a working principle of a link mechanism.

In a preferred example as shown in FIG. 5 and FIG. 6, in order to carry out an installation process of the back of the curved surface display device 01 and a test process, the bottom surface support plate 40 is connected with the base station 10 by a link mechanism 60, which is used to lift and turn the bottom surface support plate 40 to a position having an angle with respect to the bearing surface 11, so as to make it convenient for carrying out the installation of the back of the curved surface display device 01 and test.

For example, the link mechanism 60 can comprise a plurality of link rods 61-63, and one terminal of each of the link rods 61-63 is hinged on one side of the bottom surface support plate 40 facing away from the corner support pieces, and hinge positions are in a triangular pattern distribution. The link rods 61-63 can be moved along the direction perpendicular to the bearing surface 11, and the link rod 61 located in a vertex of the a triangle can be moved along the direction perpendicular to a base of the triangle within an extending direction of the bearing surface 11.

For example, the link mechanism 60 can further comprise a first drive mechanism for driving the link rods 61-63 to move along the direction perpendicular to the bearing surface 11, and a second drive mechanism for driving the link rod 61 to move along the direction perpendicular to the base of the triangle within the extending direction of the bearing surface 11. The first drive mechanism and the second drive mechanism can be realized in a screw-nut structure. The link rods 61-63 can be generally driven to move along the direction perpendicular to and away from the beating surface 11 by the first drive mechanism during lifting the curved surface display device, so that the whole the curved surface display device can be lifted. When the curved surface display device needs to be turned or rotated, as shown in FIG. 5 and FIG. 6, the link rods 61-63 can be respectively driven by the first drive mechanism, and along the direction perpendicular to the beating surface 11, a height difference between a connecting terminal of the link rod 61 connected with the bottom surface support plate 40 and a connecting terminal of the link rods 62, 63 connected with the bottom surface support plate 40 is formed, so that the curved surface display device 01 can be turned. Because the connecting mechanism is provided on the bottom surface support plate 40, the curved surface display device 01 still can be connected with the bottom surface support plate 40 after leaving the support of the corner support pieces, which makes it convenient for the curved surface display device 01 to turn over a plurality of angles; meanwhile, the link rod 61 is driven to generally move towards the rods 62, 63 within the extending direction of the bearing surface 11 by the second drive mechanism, which can further increase the turning angle of the curved surface display device 01.

The jig for assembling the curved surface display device can achieve the lifting and turning of the curved surface display device on a same jig by the link mechanism 60. The curved surface display device 01 does not need to be transferred to a separate jig for turning in process of the test or back assembly, which simplifies the assembling process of the curved surface display device.

In the preferred mode as shown in FIG. 1, in order to make the jig adapt to support curved surface display devices with different sizes, the support frame 20 comprises two first slide rails 21, 22 arranged side by side and being in parallel with the bearing surface 11 and further comprises two second sliding slide 23, 24 arranged side by side. The second slide rails 23, 24 are parallel to the bearing surface 11 and perpendicular to the first slide rails 21, 22. The second slide rails 23, 24 are installed on the two first slide rails 21, 22 and can slide along the extending direction of the first sliderails 21, 22, the corner support pieces 30 are installed on the second slide rails 23, 24 and can slide along the extending direction of the second slide rails 23, 24.

As shown in FIG. 1, in process of using the jig, the position of the two second slide rails 23, 24 on the two first slide rails 21, 22 and the position of the corner support blocks 31-34 on the second slide rails 23, 24 can be adjusted by sliding, and thus the size of the rectangle formed by the corner support blocks 31-34 can be adjusted to adapt the curved surface display device with different sizes.

What are described above is related to the illustrative embodiments of the disclosure only and not limitative to the scope of the disclosure; the scopes of the disclosure are defined by the accompanying claims.

The application claims priority to the Chinese patent application No. 201510662268.6, filed Oct. 14, 2015, the entire disclosure of which is incorporated herein by reference as part of the present application.

What is claimed is:

1. A jig for assembling a curved surface display device, comprising:

a base station provided with a bearing surface;

a support frame provided on the bearing surface, wherein the support frame is provided with a plurality of corner support pieces to support corners of the curved surface display device, a distance between each of the corner support pieces and the bearing surface is adjustable; and a bottom surface support plate provided on the bearing surface to support back of the curved surface display device.

2. The jig according to claim 1, wherein each of the corner support pieces is connected with the support frame by a lifting mechanism.

3. The jig according to claim 2, wherein the lifting mechanism comprises screws which are in one-to-one correspondence with the corner support pieces;

the screws are pivoted on the support frame and the corner support pieces are provided with thread holes matching with threads of the screws; and/or the screws are installed on the corner support pieces and the support frame is provided with thread holes connected with the threads of the screws.

4. The jig according to claim 1, wherein the plurality of corner support pieces comprise:

four corner support blocks which are in one-to-one correspondence with four corners of a frame of the curved surface display device, and the four corner support blocks are in a rectangular pattern distribution, and each of the corner support blocks is configured to support a corresponding corner in the frame.

5. The jig according to claim 1, wherein the plurality of corner support pieces further comprise:

at least one pair of side support blocks disposed opposite to each other and configured to support sides disposed opposite to each other in a frame of the curved surface display device.

6. The jig according to claim 4, wherein each of the corner support blocks comprises:

a support surface configured to support a lateral face of two sides forming a corresponding corner in the frame towards the bearing surface; and position-limiting surfaces configured to limit a position of two sides forming the corresponding corner in the frame in a direction perpendicular to the bearing surface.

7. The jig according to claim 5, wherein each of the side support blocks comprises:

a support surface configured to support a lateral face of a corresponding side in the frame towards the bearing surface; and a position-limiting surface configured to limit a position of a corresponding side in the frame in the direction perpendicular to the bearing surface.

8. The jig according to claim 1, wherein the bottom surface support plate is provided with a connecting mechanism configured to hook a bottom surface of the curved surface display device.

9. The jig according to claim 8, wherein the connecting mechanism is a wall-hanging installation groove provided on the bottom surface support plate and configured to match and connect with a wall-hanging convex structure on the bottom surface of the curved surface display device.

10. The jig according to claim 1, wherein the bottom surface support plate is connected with the base station by a link mechanism, and the link mechanism is configured to lift and turn the bottom surface support plate to a position having an angle with respect to the bearing surface.

11. The jig according to claim 10, wherein, the link mechanism comprises at least three link rods, one terminal of each of the three link rods is hinged on one side of the bottom surface support plate facing away from the corner support pieces, and hinge positions are in a triangular pattern distribution.

12. The jig according to claim 11, wherein the three link rods can be moved along a direction perpendicular to the bearing surface, and the link rod located in a vertex of a triangle can be moved along a direction perpendicular to a base of the triangle with in an extending direction of the bearing surface.

13. The jig according to claim 1, wherein the support frame comprises:

two first slide rails arranged side by side and being in parallel with the bearing surface; and two second slide rails arranged side by side, being in parallel with the bearing surface and being perpendicular to the first slide rails.

14. The jig according to claim 13, wherein each of the second slide rails is installed on the two first slide rails and can slide along an extending direction of the first slide rails, and each of the corner support pieces is installed on the second slide rails and can slide along an extending direction of the second slide rails.

15. The jig according to claim 4, wherein the plurality of corner support pieces further comprise:

at least one pair of side support blocks disposed opposite to each other and configured to support sides disposed opposite to each other in a frame of the curved surface display device.

16. The jig according to claim 5, wherein each of the side support blocks comprises:

a support surface configured to support a lateral face of a corresponding side in the frame towards the bearing surface; and a position-limiting surface configured to limit a position of a corresponding side in the frame in the direction perpendicular to the bearing surface.

17. The jig according to claim 4, wherein the bottom surface support plate is connected with the base station by a link mechanism, and the link mechanism is configured to lift and turn the bottom surface support plate to a position having an angle with respect to the bearing surface.

18. The jig according to claim 17, wherein, the link mechanism comprises at least three link rods, one terminal of each of the three link rods is hinged on one side of the bottom surface support plate facing away from the corner support pieces, and hinge positions are in a triangular pattern distribution.

19. The jig according to claim 18, wherein the three link rods can be moved along a direction perpendicular to the bearing surface, and the link rod located in a vertex of a triangle can be moved along a direction perpendicular to a base of the triangle with in an extending direction of the bearing surface.

20. The jig according to claim 4, wherein the support frame comprises:

two first slide rails arranged side by side and being in parallel with the bearing surface; and two second slide rails arranged side by side, being in parallel with the bearing surface and being perpendicular to the first slide rails.

* * * * *